US006426997B1

(12) United States Patent
Fuchs et al.

(10) Patent No.: US 6,426,997 B1
(45) Date of Patent: Jul. 30, 2002

(54) X-RAY TUBE WITH WARNING DEVICE FOR ACCURATELY INDICATING IMPENDING FAILURE OF THE THERMIONIC EMITTER

(75) Inventors: Manfred Fuchs, Nuremberg; Erich Hell, Erlangen; Markus Schild, Erlangen; Detlef Mattern, Erlangen; Peter Schardt, Aisch, all of (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/539,949

(22) Filed: Mar. 31, 2000

(30) Foreign Application Priority Data

Mar. 31, 1999 (DE) ..... 199 14 738
Mar. 31, 1999 (DE) ..... 199 14 736

(51) Int. Cl.[7] ..... H05G 1/54
(52) U.S. Cl. ..... 378/118; 378/117
(58) Field of Search ..... 378/118, 117, 378/98, 110, 111, 112

(56) References Cited

U.S. PATENT DOCUMENTS 3,955,119 A 5/1976 Perry et al. ..... 378/93
3,961,173 A * 6/1976 Perry et al. ..... 378/118
4,358,683 A 11/1982 Seifert
4,930,146 A 5/1990 Flakas et al.
5,398,274 A * 3/1995 Komatani ..... 378/110
5,901,197 A * 5/1999 Khutoryansky et al. .... 378/134
5,982,849 A 11/1999 Bischof ..... 378/130
6,212,256 B1 * 4/2001 Miesbauer et al. ..... 378/207
2001/0031036 A1 * 10/2001 Berezowitz et al. ..... 378/118

FOREIGN PATENT DOCUMENTS

DE 1 247 497 8/1967

* cited by examiner

*Primary Examiner*—Drew A. Dunn
(74) *Attorney, Agent, or Firm*—Schiff Hardin & Waite

(57) ABSTRACT

The invention concerns an x-ray tube having a thermionic emitter and a warning means, which exhibits means for measuring as least one electrical property of the thermionic emitter and produces a signal during analysis of the measured electrical property, if the measured electrical property shows a value indicating an impending failure of the thermionic emitter.

9 Claims, 2 Drawing Sheets

X-RAY TUBE WITH WARNING DEVICE FOR ACCURATELY INDICATING IMPENDING FAILURE OF THE THERMIONIC EMITTER

BACKGROUND OF THE INVENTION

1. Field of the Invention

The present invention concerns an x-ray tube of the type having a thermionic emitter.

2. Description of the Prior Art

In the event of failure of the electron emitter of an x-ray tube, the x-ray tube cannot function, or can function only to a limited degree. Important examinations therefore may not be able to be performed at the right time. In situations involving x-ray guided surgical interventions, life-threatening situations for the patient may arise from a sudden failure of the emitter.

In such emergencies, if the x-ray tube is of the type having two emitters (large focus and small focus), one can, in a critical case, switch over to the still-intact emitter, in order to be able to continue working even given—under the circumstances—greatly reduced image quality. For x-ray tubes where only one emitter is provided, this method is, of course, not possible.

A simple replacement of each x-ray tube after a specified standard life (e.g. average serviceable life) still does not solve the above problem either. This is because there are always cases in which the serviceable life of an emitter is very much shorter than the standard life, so that in such cases, the disadvantageous, sudden x-ray tube failures as described above can occur. Also, a significant safety margin from the standard life would have to be constantly maintained in order to keep the number of these cases optimally negligible for safety purposes, and a tube replacement would already have to occur in a timely fashion prior thereto, which, however, would correspondingly reduce the usage time of an x-ray tube and would raise the costs of its use accordingly.

The length of time that the serviceable life that an x-ray tube actually attains deviates from the standard life span depends considerably on the circumstances under which the x-ray tube was operated. The tube current, and thereby the electron current (emission current) emanating from the emitter, is of particular significance since x-ray tubes frequently fail due to burnout or breakage (fracture) of the emitter. At high tube currents, the temperature of the emitter, and thus also the vaporization rate at which material is vaporized from the emitter, is higher than at low tube currents. Nevertheless, it has been shown that a sufficiently exact prediction of the failure time of an x-ray tube is not possible, even if the emission current is monitored as a function of time.

This is particularly true for emitters of the type that consist of thin, e.g. only 75 $\mu$m thick, sheet metal, e.g. tungsten sheet metal, since in such emitters the thermomechanical stresses which occur in the range of the emission temperature (2,350° C. for tungsten) are already sufficient to allow the emitter to break, if it has become further thinned due to the evaporation process.

SUMMARY OF THE INVENTION

An object of the present invention is to provide an xray tube of the type initially described wherein safe use of the x-ray tube is possible until shortly before the end of the emitter life.

This object is achieved in accordance with the invention in an x-ray tube having a warning device which measures at least one electrical property of the thermionic emitter and, by analysis of the measured electrical property or properties, generates a signal, if the measured electrical property shows a value indicating an impending failure of the thermionic emitter.

The generation of the signal ensues, therefore, not on the basis of monitoring of operating parameters of the x-ray tubes; rather, it ensues on the basis of evaluation of measured electrical properties of the emitter itself, so that an exact prediction of the aging status of the emitter is possible, and thus, a use of the x-ray tube without risk is possible until shortly before the end of the emitter life.

According to a first version of the invention, the warning device measures the emitter resistance and produces a signal upon attaining a given, characteristic resistance change. This signal can serve to control a signal generator and/or be supplied to the control unit of the x-ray system, in which the x-ray tube is used, in order to institute appropriate switch-over procedures.

The change in resistance of the emitter is appropriate as a criterion for the generation of the signal because a part of its emitting substance evaporates from the surface during the aging of the thermionic emitter. The conductor cross-section thus becomes reduced, causing the emitter resistance to rise. This effect is measurable in a directly heated emitter on the basis of monitoring the filament current and/or filament voltage of the emitter. Two different possibilities to produce a signal indicating the impending emitter failure—via the occurrence of a resistance change since both of these parameters are dependent on a change in resistance of the emitter as a function of the operating life.

As noted above, the emitter resistance increases during the operating life. The cause is the constant vaporization of material during operation (typically $10^{-8}$ g/(cm$^2$·sec) for tungsten at 2,350° C.). The conductor cross-section becomes smaller as a result and the resistance rises, which is proportionally recognizable as reduction in the filament current relative to a given filament voltage. As a first embodiment, therefore the warning device can emit a signal at a given percentage resistance increase, e.g. at a change in resistance around 10% compared to the resistance of a new emitter.

The temperature distribution of a thermionic emitter is never completely homogeneous. There are always locations that are somewhat hotter than the ambient area and more material evaporates at these hot locations. The conductor cross-section becomes more considerably reduced at such a hotshot and this ultimately leads to melting of the emitter material due to locally increased heating and thereby increased vaporization. This coupling of heating and vaporization related to melting leads to a considerably disproportional increase of the resistance in relation to the burnout life near the end of the emitter life.

Thus as a second embodiment for recognizing an impending emitter failure the warning device emits a signal when a given time gradient (rate of change) of the percentage resistance increase occurs. The repeated, considerable resistance increase—described above—in the last operating time prior to emitter failure such as a "jump" of approximately 8%, compared to the very slow resistance increase over the total life at 10%, allows the x-ray tube to be used until a few hours before the final failure of the emitter, since the considerable time gradient of the change in resistance in the last operating hours can be measured on the basis of the asymmetrical vaporization, and can be used to produce the signal indicating impending emitter failure.

In a further version of the invention, the warning device is a current measuring device, that determines the quotient of the turn-on emission current $I_{in}$ when applying the tube filament voltage to the smaller equilibrium current $I_{equil}$ which subsequently develops and, from this variation of the quotient during the emitter operating time, the warning device derives a signal indicating the impending failure of the emitter.

The variation of this quotient is appropriate as a criterion for the signal generation because this quotient initially changes only to a limited degree during the operating life of the tube, and increases very considerably just before the end of the serviceable life of the emitter.

If the emitter is brought to a constant emission temperature prior to switching on the high voltage, the result is the characteristic decrease of the emission current within approximately 200 ms due, to a cooling effect produced by the removal of thermal energy (corresponding to the emission temperature) due to the emitted electrons.

In the course of the serviceable life of the emitter, this becomes thinner due to evaporation as described. In this manner the thermal capacity, and the thermal conductivity due to the modified thermal conduction, decrease from the emitter interior to the emitter surface, that is considerably cooled by the electron emission which occurs after switching on the high voltage, so that the surface temperature drops accordingly and thereby the equilibrium emission current decreases. The equilibrium current is the current that would arise if the emitter were heated with the tube voltage across the emitter over a specific time. The absolute value of the equilibrium emission current depends on the emitter temperature as well as on the high voltage. Therefore, it is expedient—for precluding errors caused by such influences—to measure not the equilibrium emission current alone, but rather to always measure the turn-on emission current $I_{in}$ and the subsequently arising equilibrium current$_{lequil,}$ separated by a limited time span of e.g. somewhat more than 200 ms to form the aforementioned quotient. The turn-on emission current $I_{in}$ is the current that is present immediately after switching on the tube voltage after the emitter has been heated without tube voltage. Independent of the absolute values of the temperatures and voltages, this quotient $I_{in}/I_{equil}$ is a reliable indicator for the remaining available emitter life. This quotient can be used, for example, so that a signal that indicates the impending emitter failure is emitted upon the occurrence of a predetermined percentage change of the quotient $I_{in}/I_{equil}$ compared to the start value at the beginning of operation of the x-ray tube.

In a further embodiment of the invention, instead of using the change of the quotient $I_{in}/I_{equil}$ as the trigger for the signal, rather the time gradient of this quotient is determined over the operating time of the emitter. It has been shown that the quotient $I_{in}/I_{equil}$ changes considerably just before the failure of the emitter and thus a correspondingly steeper time gradient occurs. This makes it possible to generate the signal indicating the impending emitter failure in a manner that is significantly more sensitive, and coming closer to the actual end of the emitter life. The x-ray tube thus can be operated over an operating time that is almost as long as the x-ray tube life limited by the failure of the emitter, without having to take into account the disadvantages mentioned above.

DESCRIPTION OF THE PREFERRED EMBODIMENTS

Figure 1:
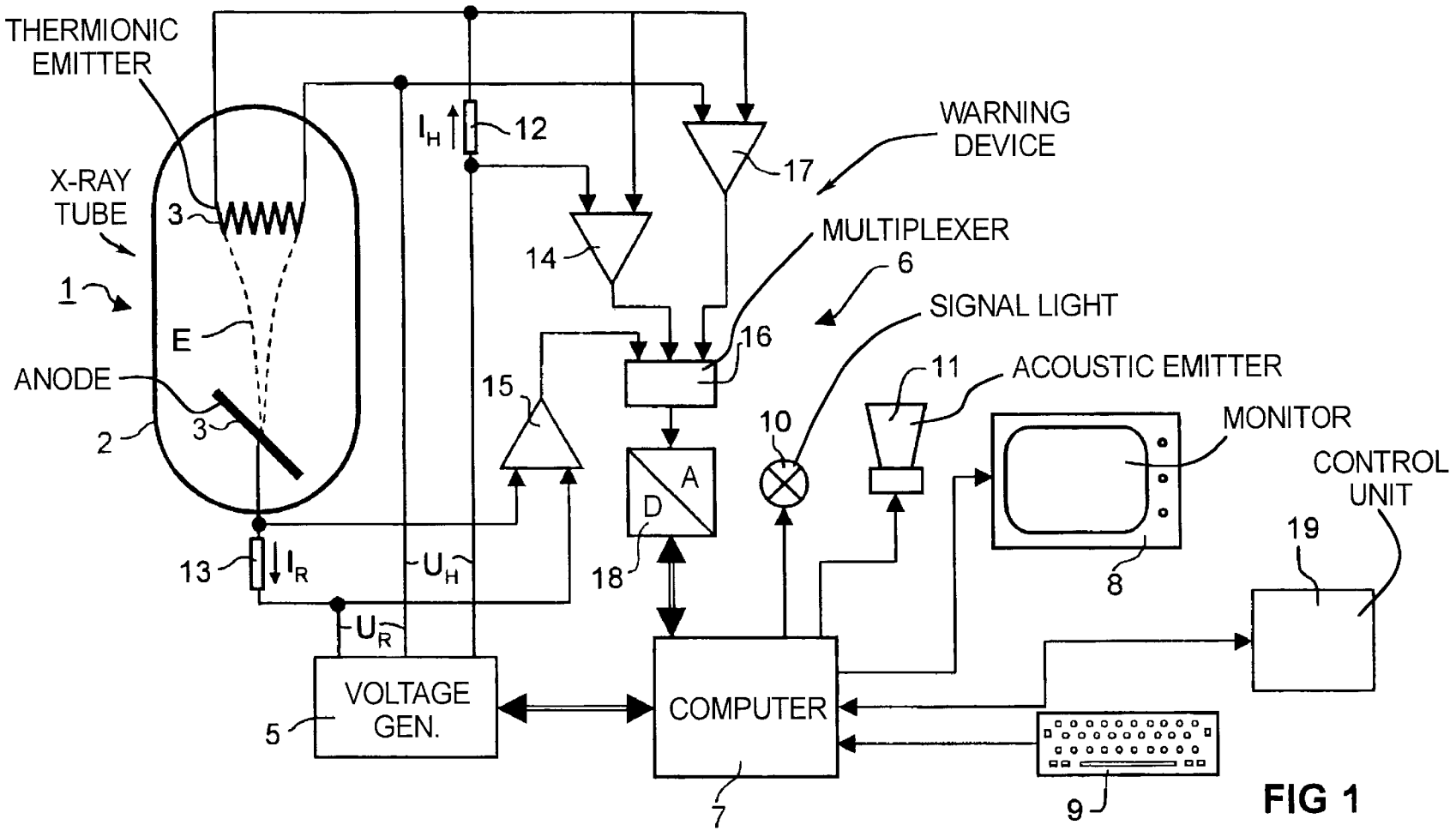
FIG. 1 schematically illustrates an inventive x-ray tube having a thermionic emitter.

FIG. 1 shows an inventive x-ray tube generally referenced 1, having a vacuum housing 2 containing an anode 3 and a thermionic emitter 4 disposed opposite therefrom, as the cathode.

A voltage generator 5 supplies the x-ray tube 1 with the voltages and currents required for its operation. A filament voltage UH is provided to the emitter 4. The emitter 4 is heated directly by current flowing therethrough, so that a filament current $I_H$ flows through the emitter 4, which is selected with respect to the electrical resistance of the emitter 4 such that the emitter 4 is heated to a temperature at which the emission of electrons ensues. If the emitter is formed of tungsten, this temperature is at 2,350° C.

The tube voltage $U_R$ is a terminal of the emitter 4 and the anode 3, causing the electrons emitted from the emitter 4 to be accelerated to the anode 3 in the form of an electron beam indicated by dotted lines in FIG. 1. The electrons strike the anode and produce x-rays. The tube current thus corresponds essentially to the emission current l of the emitter 4.

The x-ray tube 1 has a warning device 6, that measures electrical properties of the emitter 4, and produces a signal by analysis of the measured electrical properties, if one or several measured electrical properties has a value indicating an impending failure of the emitter 4.

In the exemplary embodiment, the warning device 6 includes an electronic computer 7, to which a monitor 8 and a keyboard 9 are connected. The computer 7 also serves for setting the filament current $I_H$ and the filament voltage $U_H$ as well as the tube or emission current l and the tube voltage $U_R$, which is indicated by a corresponding connection to the voltage generator 5. The computer 7 monitors the measured electrical properties of the emitter 4 and triggers the output of a corresponding signal. A signal light 10 and an acoustic emitter 11 are provided as signal indicators in the exemplary embodiment described. In addition, the computer 7 can display a signal on the monitor 8 as well as in alphanumeric or graphic form.

The computer 7 is connected to a control unit 19 which is a component of the device in which the x-ray tube 1 is used, so that in the event of the output of a signal indicating the impending failure of the emitter 4, a corresponding signal can also be given to the control unit 19.

Measurement of the electrical properties of the emitter 4 is accomplished using two shunt-resistors 12, 13, that are arranged such that the shunt-resistor 12 conducts the filament current $I_H$ and the shunt-resistor 13 conducts the emission current l. The respective voltage drops across the shunt-resistors 12 and 13, corresponding to the filament current $I_H$ and the emission current l, are measured by differential amplifiers 14 and 15, the output signals of which are fed to the inputs of a 3:1-analog-multiplexer 16. A signal corresponding to the filament voltage $U_H$ is obtained by an additional differential amplifier 17 and is fed to the remaining input of the 3:1-analog-multiplexer. The output of the 3:1-analog-multiplexer 16 is connected to the input of an analog-to-digital converter 18, which feeds digital data corresponding to the filament current $I_H$, the emission current l and the filament voltage $U_H$ to the computer 7.

In a first operating mode of the warning device 6 set by the keyboard 9, the computer 7 determines the electrical resistance of the emitter 4 from the filament voltage $I_H$ and $U_H$, and compares the current value of the resistance of the emitter 4 with the start value, which occurred at start-up of the x-ray tube 1 and was stored in the computer 7. The computer 7 determines the start value of the electrical resistance from the start values of the filament current $I_{Hstart}$ and the filament voltage $U_{HStart}$, which are present during the startup use of the x-ray tube 1. If the value of the electrical resistance of the emitter 4 has decreased by a specific percentage—e.g. 10% compared to its start value (this percentage will be dependent on the structural type of the respective x-ray tube or the type of emitter 4 and can be experimentally determined), the computer 7 triggers the output of the signal indicating the impending failure of the emitter 4, this signal activates the signal light 10 and/or the acoustic emitter 11 and/or the monitor 8, and/or feeds a signal to the control unit 19.

In a version, which can be entered via the keyboard 9, of the described operating mode, the computer 7 determines the time gradient with which the electrical resistance of the emitter 4 changes and then emits the signal indicating the impending failure of the emitter 4 if the time gradient of the change in resistance exceeds a threshold. This threshold can also be determined experimentally for the type of the x-ray tube 1 or the type of emitter 4.

Both of these operating modes for the warning device 6 are based on the fact that gradual evaporation of the emitter 4 material causes the electrical resistance of the emitter 4 to gradually rise, over the greatest part of the life of the emitter 4, with a constant time gradient that increases considerably, however, near the end of the life of emitter 4.

Figure 2:
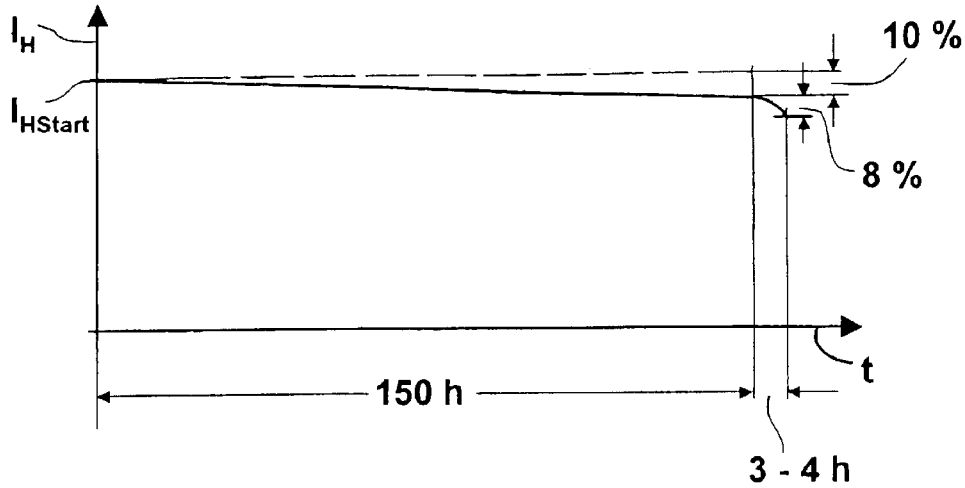
FIG. 2 shows the filament current of the thermionic emitter of the x-ray tube of FIG. 1 as a function of the on-time.

This can be seen in FIG. 2 on the basis of the time curve of the filament current $I_H$, that is inversely proportional to the electrical resistance of the emitter at a constant filament voltage $U_H$.

During the on-time of x-ray tube 1 and thus the emitter 4, the filament current $I_H$ decreases very gradually at a nearly constant time gradient. This occurs, for example, as shown in FIG. 2, proceeding from a start value $I_{Hstart}$ corresponding to the start value of the electrical resistance, the decrease typically amounting to about 10% of the start value $I_{Hstart}$ shortly before the ultimate failure of the emitter 4 as in the case of the example illustrated in FIG. 1. This gradual decrease over an on-time of e.g. about 150 hours is used in the first version of the first operating mode for the warning device 6—to produce the signal when the threshold indicating the impending failure of the emitter 4 and thus the x-ray tube 1 is exceeded. This is determined by comparing the current value of the resistance of the emitter 4 with a given threshold value input via the keyboard 9. For the example illustrated in FIG. 2, this is a 10% decrease in the filament current $I_H$ and thus a 10% increase of the resistance of the emitter 4. When this signal is emitted, there are still several hours of operating life available, so that an urgent examination can still be performed before replacing the x-ray tube 1, without the danger of the x-ray tube 1 failing during the examination.

During the last one to three hours and specifically during the last hour, of the life of the emitter 4, the evaporation becomes intensified by the previously mentioned asymmetrical temperature distribution and the vaporization of material of the emitter 4 resulting therefrom. This causes another very steep rise in the resistance of the emitter 4 and, resulting therefrom, a correspondingly very much steeper drop in the filament current $I_h$ This rise or drop reaches a value of an additional 8% (approximately) in the last operating hours in the example illustrated in FIG. 2.

The high time gradient of the percentage increase of the resistance or of the percentage decrease in filament current $I_H$ just before the end of the life of emitter 4 makes it possible to emit the signal in the second version of the first operating mode for the warning device 6 very shortly before the actual failure of the emitter 4. This allows use of practically all the maximum x-ray tube 1 on-time that is possible due to the actual life of the x-ray tube 1, without concern about an unexpected failure of the x-ray tube 1.

For this purpose, the current value of the gradient of the time change in of the resistance of the emitter 4 is determined by the computer 7 and is compared with a given gradient threshold that is entered via the keyboard 9, and the signal indicating the impending failure of the emitter 4 and thus the x-ray tube 1 is produced when the threshold value is exceeded. The threshold value can be experimentally determined for the particular structure of the x-ray tube 1 or the particular structure of the emitter 4 contained therein.

In a second operating mode of the warning device 6 which can be selected using the keyboard 9, a test cycle is run at periodic intervals, that entails heating the emitter 4 to a constant emission temperature without the tube voltage $U_R$ being across at the x-ray tube 1, and the tube voltage $U_R$ is switched on after the heating. The computer 7 determines the time curve of the emission current I, or at least the turn-on emission current $I_{in}$ which is present prior to applying the tube voltage $U_R$, and equilibrium emission current $I_{equil}$ which is reached after switching on the tube voltage $U_R$.

Figure 3:
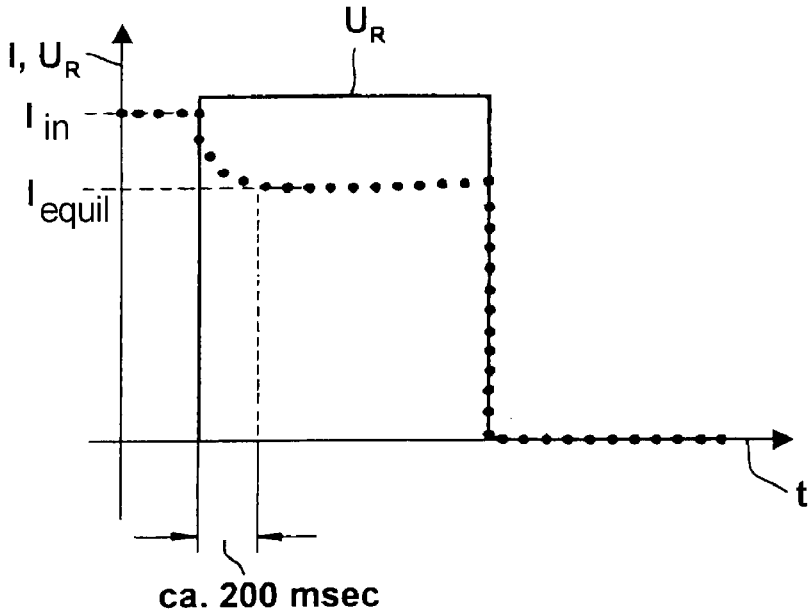
FIG. 3 shows the tube current (dotted) upon switching on the high voltage ( solid) as a function of time, for the x-ray tube of FIG. 1.

In running this test cycle, a characteristic reduction in the emission current I in a manner shown in FIG. 3 results subsequent to applying the tube voltage $U_R$ such that within a relatively short time span—200 ms in the example of FIG. 3—a drop ensues from the turn-on emission current $I_{in}$ to the equilibrium emission current $I_{equil}$. This effect is, as previously explained, based on the fact that electrons emitted by the emitter 4 remove thermal energy.

As a result of the vaporization of material of the emitter 4, for a defined emission current I that is present during the test cycle, i.e. an equilibrium emission current $I_{equil}$, of e.g. 300 mA, the equilibrium which arises over increased on-time of the emitter 4 is increasingly determined by the mechanisms of thermal radiation, of cooling by the emission of electrons, and less by the thermal conductivity of the emitter 4 area which forms the radiating surface for electrons e.g. between its connection terminal pins. In this manner a characteristic change of the cooling effect that appears subsequent to the application of the tube voltage results, that causes the quotient of $I_{in}/I_{equil}$ to become greater with increasing life of the emitter 4.

Figure 4:
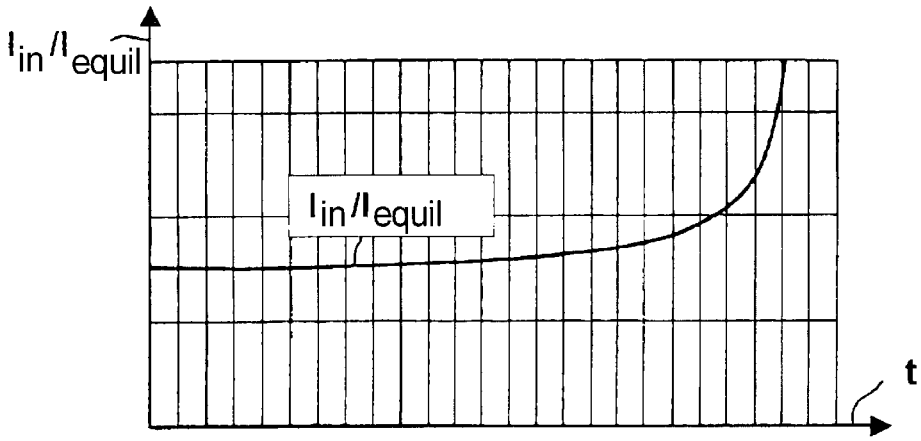
FIG. 4 shows the quotient $I_{in}/I_{equil}$ as a function of time for the x-ray tube according to FIG. 1.

This is evident from FIG. 4 in which the time curve of the quotient $I_{in}/I_{equil}$ for an exemplary emitter is shown over its life of approximately 276 hours. As can be seen, a dramatic increase of the quotient $I_{in}/I_{equil}$ occurs shortly before the actual end of the life of the emitter 4 and thus the x-ray tube 1.

The warning device 6 uses this increase, in the second operating mode, as the indicator for the impending end of the life of the emitter 4.

In a first version of the second operating mode which can be entered via the keyboard 9, the computer 7 determines the quotient $I_{in}/I_{equil}$ in the test cycle and compares this to a threshold value, that can be experimentally determined for the respective structure of the x-ray tube 1 or the structure of the emitter 4 contained therein. The threshold is selected such that the warning device 6 then produces the signal indicating the impending failure of the emitter 4, if the quotient $I_{in}/I_{equil}$ has increased to a percentage corresponding to the threshold compared to its start value at the startup use of the x-ray tube 1, that is determined in the first test cycle and stored in the computer 7.

In a second version of the second operating mode which can be entered via the keyboard 9, the computer 7 determines the quotient $I_{in}/I_{equil}$ in a number of test cycles and stores the corresponding values so that the time curve of quotient $I_{in}/I_{equil}$ is known. From this time curve of the quotient $I_{in}/I_{equil}$ the computer 7 determines the time gradient in the course of each test cycle, with which the quotient $I_{in}/I_{equil}$ changes and compares this gradient to a corresponding threshold.

The warning device 6 then produces the signal indicating the impending failure of the emitter, if the time gradient of the change in the quotient $I_{in}/I'_{in}/I_{equil}$ exceeds the corresponding threshold that can be experimentally determined for the structure of the x-ray tube 1 or the structure of the emitter 4 contained therein.

The warning device 6 can run the test cycle as a subroutine of a regularly executed calibration or test program of the device, in which the x-ray tube is used e.g. of a computer tomography system or diagnostic x-ray system. The warning device 6 is then activated accordingly by the control unit 19 of this device.

The invention has been explained with reference to the example of an x-ray tube 1, in which the anode and the cathode are stationary with respect to one another. The invention also can be used in x-ray tubes, in which a relative movement is possible between the cathode and the anode, e.g. those referred to as rotary anode tubes or rotary bulb tubes.

Although modifications and changes may be suggested by those skilled in the art, it is the intention of the inventor to embody within the patent warranted hereon all changes and modifications as reasonably and properly come within the scope of his contribution to the art.

We claim as our invention:

1. An x-ray tube comprising:

a cathode/anode system for generating x-rays, including a thermionic emitter, said thermionic emitter having a plurality of electrical properties; and a warning device for indicating an impending failure of said thermionic emitter by measuring at least one of said electrical properties of said thermionic emitter, as a measured property, and analyzing said measured property, and generating a signal if said measured property has a value indicating the impending failure of the thermionic emitter.

2. An x-ray tube as claimed in claim 1 wherein said at least one electrical property is resistance of the thermionic emitter, and wherein said warning device generates said signal if said resistance exhibits a predetermined change.

3. An x-ray tube as claimed in claim 2 further comprising means for supplying said thermionic emitter with a filament current and a filament voltage, and wherein said warning device measures said resistance by measuring at least one of said filament current and said filament voltage.

4. An x-ray tube as claimed in claim 2 wherein said warning device generates said signal if said resistance exceeds a predetermined percentage increase.

5. An x-ray tube as claimed in claim 2 wherein said warning device identifies a time gradient of said resistance, and generates said signal if said time gradient exhibits a predetermined percentage increase.

6. An x-ray tube as claimed in claim 1 further comprising means for applying a tube voltage between said cathode and said anode and thereby producing an emission current $I_{in}$ when said tube voltage is applied, with an equilibrium emission current $I_{equil}$ subsequently arising, and wherein said warning device measures a quotient $I_{in}/I_{equil}$ as a function of on-time of said thermionic emitter as said at least one property, and generates said signal dependent on a change of said quotient as a function of the on-time.

7. An x-ray tube as claimed in claim 6 wherein said warning device determines a time curve of said quotient over an accumulated on-time of said thermionic emitter.

8. An x-ray tube as claimed in claim 6 further comprising a control unit which regularly executes a calibration program, at least for said cathode/anode system, upon application of said tube voltage, and wherein said warning device measures said emission current and said equilibrium emission current as a subroutine of each execution of said calibration program.

9. An x-ray tube as claimed in claim 1 wherein said warning device measures said at least one property in analog form, to obtain an analog measurement result, and wherein said warning device includes an analog—to—digital converter to convert said analog measurement result into a digital signal forming said signal indicating an impending failure of said thermionic emitter.

* * * * *